US005586680A

United States Patent [19]

Dellby et al.

[11] Patent Number: 5,586,680

[45] Date of Patent: Dec. 24, 1996

[54] BOX CONSTITUTING VACUUM INSULATED WALLS OF A REFRIGERATOR OR FREEZER CABINET

[75] Inventors: Fredrik Dellby, Enskede; Per Åke Fonser, Stockholm, both of Sweden

[73] Assignee: Aktiebolaget Electrolux, Stockholm, Sweden

[21] Appl. No.: 556,126

[22] Filed: Nov. 9, 1995

Related U.S. Application Data

[63] Continuation of Ser. No. 346,751, Nov. 30, 1994, abandoned.

[30] Foreign Application Priority Data

Dec. 22, 1993 [SE] Sweden ..... 9304248

[51] Int. Cl.[6] ..... B65D 25/00

[52] U.S. Cl. ..... 220/467; 220/469

[58] Field of Search ..... 220/467, 420, 220/421, 425, 431, 469, 467

[56] References Cited

U.S. PATENT DOCUMENTS

| | | | |
|---|---|---|---|
| 1,955,381 | 4/1934 | Forsthoefer | 220/467 X |
| 2,123,403 | 7/1938 | Connelly | 220/467 X |
| 2,164,143 | 6/1939 | Munters | 220/9 |
| 2,328,467 | 8/1943 | La Casse | 220/467 X |
| 2,622,754 | 12/1952 | Eagles | 220/467 X |
| 2,644,607 | 7/1953 | Hinkel | 220/467 X |
| 2,835,405 | 5/1958 | Gilbert et al. | 220/467 X |
| 2,855,636 | 10/1958 | Donnelly | 220/467 X |
| 3,883,198 | 5/1975 | Tillman . | |
| 3,940,195 | 2/1976 | Tillman | 220/467 X |
| 4,134,518 | 1/1979 | Menchen | 220/467 X |
| 4,834,471 | 5/1989 | Pasqualini . | |

FOREIGN PATENT DOCUMENTS

| | | |
|---|---|---|
| 0260699 | 3/1988 | European Pat. Off. . |
| 0258536 | 3/1988 | European Pat. Off. . |
| 1501237 | 12/1969 | Germany . |
| 1061204 | 3/1967 | United Kingdom . |
| 1103748 | 2/1968 | United Kingdom . |
| 2175680 | 12/1986 | United Kingdom . |

OTHER PUBLICATIONS

Enclosure A—WPAT English Abstract of EP 0,258,536.

*Primary Examiner*—Steven M. Pollard

*Attorney, Agent, or Firm*—Pearne, Gordon, McCoy & Granger

[57] ABSTRACT

A box constituting heat insulating walls of a refrigerator or freezer cabinet, wherein the walls are formed by an inner shell of metal, an outer shell of metal, and an evacuated heat insulation between the shells. The shells provide edges which surround a rectangular access opening to the box and which are folded towards each other so that they form planar surfaces located in substantially the same plane. The planar surfaces are gas-imperviously connected to each other by a thin metal strip having poor heat conductivity. The strip is soldered to the planar surfaces.

8 Claims, 1 Drawing Sheet

BOX CONSTITUTING VACUUM INSULATED WALLS OF A REFRIGERATOR OR FREEZER CABINET

This is a continuation of application Ser. No. 08/346,751, filed Nov. 30, 1994, now abandoned.

BACKGROUND OF THE INVENTION

The present invention relates to a box constituting heat insulating walls of a refrigerator or freezer cabinet wherein the walls are formed by an inner shell of metal, an outer shell of metal, and an evacuated heat insulation between the shells, wherein the shells, at a rectangular access opening to the box, have edges which are gas-imperviously connected to each other by a thin metal strip having poor heat conductivity.

A box of this type is shown in U.S. Pat. No. 2,164,143. The '143 box provides heat insulation consisting of a powder which is under vacuum. A strip, which prevents air from entering the insulation while also preventing heat from being conducted from the outer shell to the inner shell, has a bent cross-section. As a consequence of the bent shape of the strip, the joints of the strip at the corners of the access opening are bent. Because of the bent shape, the joints are complicated to make.

SUMMARY OF THE INVENTION

An object of the present invention is to bring about a connection between the edges of the inner and outer shells of a box which is easy to manufacture.

In accordance with the present invention, edges of the inner and outer shells are folded towards each other so that they form planar surfaces located in substantially one and the same plane. A strip is soldered to the planar surfaces.

It shall be pointed out that it, through GB Patent No. 1,061,204, is known, per se, to bridge an edge surrounding a plane vacuum insulated panel by soldering on thin strips of a poor heat conducting material. The strip, which is broader than the panel, is folded over the panel and is soldered to the panel with its folded part. This method of folding and fastening the strip to the panel is, however, not suitable for bridging the edge around an access opening of a box, and is especially not suitable at the corners of the access opening.

BRIEF DESCRIPTION OF THE DRAWINGS

The preferred embodiment of a box according to the present invention is described below with reference to the attached drawings, wherein.

DETAILED DESCRIPTION OF THE PREFERRED EMBODIMENT

Figure 1:
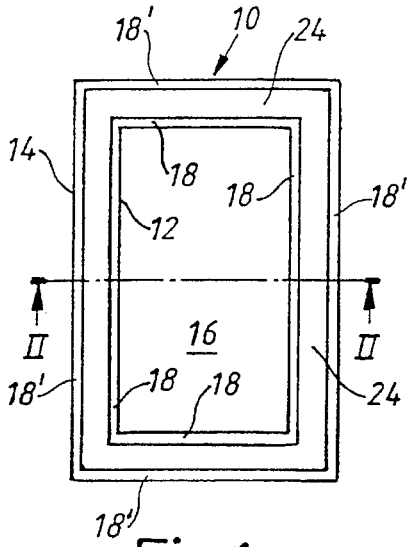
FIG. 1 is a front elevational view of a box looking into an access opening.

With reference to FIG. 1, a box 10 according to the present invention is shown to include an inner shell 12 and an outer shell 14. The inner and outer shells 12, 14 are preferably formed from plate iron having a thickness of about 0.6 mm. At a rectangular access opening 16 to the box 10, edges of the shells 12, 14 are folded towards each other so that they form planar surfaces 18, 18'. Preferably, the planar surfaces 18, 18' are located in one and the same plane, i.e., are co-planar with one another.

Figure 2:
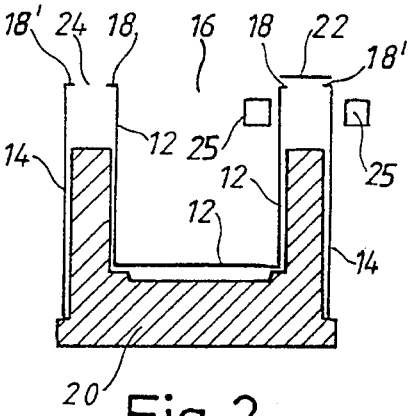
FIG. 2 is a cross-sectional view of the box as viewed from line II—II of FIG. 1, with the box located on a fixture.

In FIG. 2 the shells 12, 14 are shown placed on a fixture 20 which keeps the surfaces 18, 18' mutually fixed when a planar strip 22, which bridges a gap 24 between the shells at the access opening 16, is soldered to the surfaces 18, 18'. The solder is preferably melted in inductive way by means of two coils 25 which heat the shells 12, 14 which, in turn, heat and melt the solder. In order that the heat loss or conduction through the strip 22 is as small as possible, a strip 22 is chosen which is as thin as possible and made from a material which conducts heat poorly. Preferably, the strip 22 is formed out of stainless steel and has a thickness of 0.05 mm.

Figure 3:
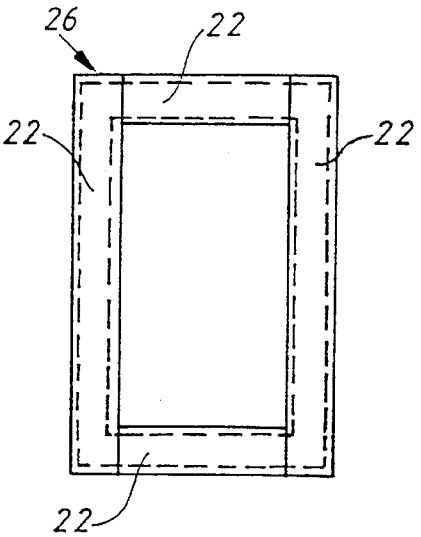
FIG. 3 is a front elevational view of the box similar to FIG. 1, but showing strips soldered on around the access opening.
Figure 4:
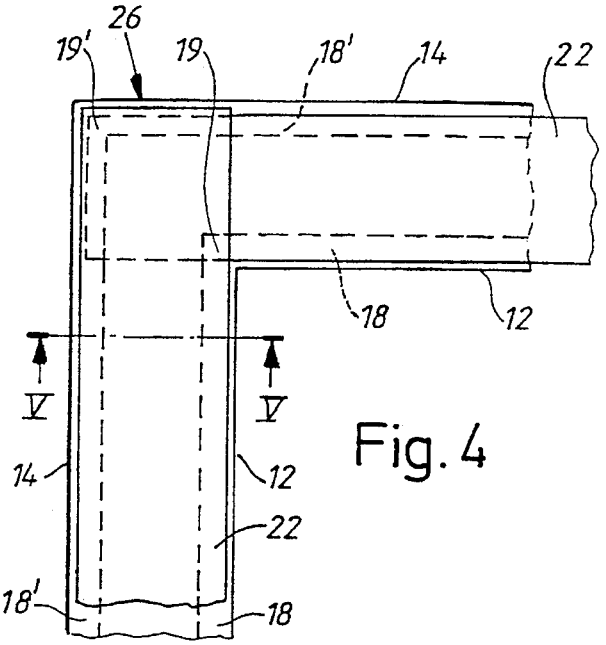
FIG. 4 shows an enlargement of the upper left corner of the box shown in FIG. 3.

FIG. 3 shows how the gap 24 has been sealed by four straight strips 22 which overlap each other at the corners 26 of the access opening 16. Such a corner 26 is shown in enlargement in FIGS. 4 and 5. The solder also connects the strips 22 mutually at the corners 26, where they overlap each other. The surfaces 18, 18' are suitably constituted by a part of the respective shell folded 90°. Crevices, which occur after the folding at corners 19, 19' between adjoining surfaces 18, 18' are filled before the strips 22 are soldered on by weld material or welded-on plate pieces and are made even or flat so that a good backing surface for the strips 22 is obtained at the corners 19, 19'.

Figure 6:
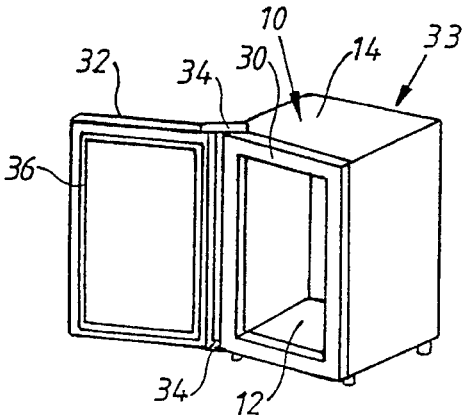
FIG. 6 is a perspective view of a refrigerator or freezer cabinet, of which the box is a part.
Figure 5:
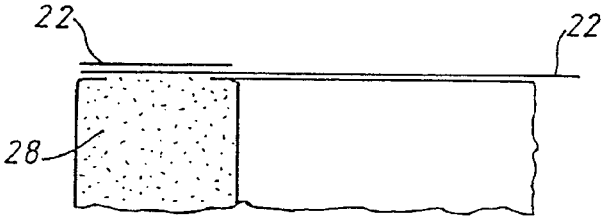
FIG. 5 is a cross-sectional view as seen from line V—V of FIG. 4.

When the strips 22 have been soldered to the edges or surfaces 18, 18' around the access opening 16 and have been soldered mutually together at the corners 26, the space between the shells 12, 14 is filled with a heat insulating powder 28, after which the space is evacuated and sealed (FIG. 5). With reference to FIG. 6, a plastic frame 30 is fastened over or on the outside of the strips 22 to protect the strips against mechanical damage. The box 10 is equipped with a door 32 and a refrigerating apparatus (not shown) and is, after surface conditioning, ready to be used as a refrigerator or freezer 33. The door 32 is journalled in arms 34, which are fastened to the shell 14. A seal 36, which is fastened to the door 32, seals against the frame 30 when the door is closed. The box 10 with the door 32 and the refrigerating apparatus can also be used as a refrigerator or freezer box with the access opening located in a horizontal plane. Furthermore, the box 10 with the door 32 can be used without a refrigerating apparatus as a heat insulating cabinet.

The door 32 can consist of an element with one iron plate forming the outside and edges of the door and one iron plate forming the inside of the door, which plates enclose an evacuated heat insulation. A gap runs between the plates around the inside of the door close to its periphery. Adjacent to the gap, the plates show plane surfaces located in one and the same plane like the surfaces 18. Heat is prevented from being conducted through the plates from the outside to the inside of the door by thin metal strips, which in the same way as the strips 22, bridge the gap and are soldered to the surfaces.

Although the preferred embodiment of the present invention is particularly and specifically described in the foregoing, it should be clear that the present invention is capable of various modifications, rearrangements, and substitutions of parts without departing from the scope and spirit of the invention as defined by the claims appended hereto.

What is claimed is:

1. A box forming heat insulating walls of a refrigerator or freezer cabinet, said walls comprising an inner metal shell, an outer metal shell, and an evacuated heat insulation between the shells, said shells having edges which surround a rectangular access opening to the box and which are gas imperviously connected to each other by a thin metal strip having poor heat conductivity, wherein the edges are folded toward each other so that said edges form planar surfaces located in substantially one and the same plane as said access opening, said planar surfaces surrounding said rectangular access opening in said substantially one and the same plane, and wherein the strip is generally flat and soldered to the planar surfaces.

2. Arrangement according to claim 1, wherein a plurality of strips connect the planar surfaces together, two of said strips overlapping each other and being soldered to each other and to the surfaces.

3. Arrangement according to claim 2, wherein said two strips overlap each other and are soldered to each other and to the surfaces at a corner of the access opening.

4. Arrangement according to claim 1, wherein crevices at corners of the rectangular opening between adjoining surfaces are filled to obtain a generally flat backing surface for said strip and said strip is soldered to said planar surfaces and said backing surface.

5. A heat insulating box for a refrigerator or freezer cabinet having a rectangular access opening, said box comprising:

an inner metal shell having edges surrounding the access opening;

an outer metal shell having edges surrounding the access opening, said edges of said inner metal shell folding toward said edges of said outer metal shell to form a planar surface and said edges of said outer metal shell folding toward said edges of said inner metal shell to form a planar surface, said planar surfaces of said inner and outer metal shells being in substantially one and the same plane as said access opening and surrounding the access opening in said substantially one and the same plane;

an evacuated heat insulation between said inner metal shell and said outer metal shell; and a thin metal strip surrounding said access opening and attached to said planar surfaces to gas-imperviously connect said inner metal shell to said outer metal shell, wherein said strip is soldered to said planar surfaces.

6. A box according to claim 5, wherein said thin metal strip is substantially planar.

7. A box according to claim 5, wherein said strip includes a plurality of overlapping segments.

8. A box according to claim 7 wherein said segments overlap each other at corners of the access opening.

* * * * *